US007710274B2

(12) United States Patent
Choi et al.

(10) Patent No.: US 7,710,274 B2
(45) Date of Patent: May 4, 2010

(54) ANTENNA HAVING LOOP AND HELICAL STRUCTURE AND RFID TAG USING THE SAME

(75) Inventors: Won-Kyu Choi, Daejon (KR); Hae-Won Son, Daejon (KR); Gil-Young Choi, Daejon (KR); Jung-Hyung Ha, Seoul (KR); Noh-Hoon Myung, Daejon (KR)

(73) Assignees: Electronics and Telecommunications Research Institute, Daejon (KR); Korea Advanced Institute of Science and Technology, Daejeon (KR)

( * ) Notice: Subject to any disclaimer, the term of this patent is extended or adjusted under 35 U.S.C. 154(b) by 291 days.

(21) Appl. No.: 11/771,162

(22) Filed: Jun. 29, 2007

(65) Prior Publication Data

US 2008/0180216 A1 Jul. 31, 2008

(30) Foreign Application Priority Data

Jun. 30, 2006 (KR) ..... 10-2006-0061387

(51) Int. Cl.

| | |
|---|---|
| ***G08B 13/14*** | (2006.01) |
| ***H01Q 1/00*** | (2006.01) |
| ***H01Q 13/10*** | (2006.01) |
| ***H01Q 1/36*** | (2006.01) |

(52) U.S. Cl. ..... 340/572.7; 340/572.1; 343/700 MS; 343/767; 343/787; 343/788; 343/895

(58) Field of Classification Search ..... None
See application file for complete search history.

(56) References Cited

U.S. PATENT DOCUMENTS

| | | | | |
|---|---|---|---|---|
| 5,777,561 | A * | 7/1998 | Chieu et al. | 340/10.32 |
| 5,986,616 | A * | 11/1999 | Edvardsson | 343/853 |
| 6,028,564 | A | 2/2000 | Duan et al. | |
| 6,204,817 | B1 * | 3/2001 | Edvardsson | 343/702 |
| 6,580,357 | B1 | 6/2003 | Forster et al. | |
| 6,641,052 | B2 | 11/2003 | Baillod et al. | |
| 6,806,832 | B2 * | 10/2004 | Sato et al. | 343/700 MS |
| 6,895,655 | B2 | 5/2005 | Forster et al. | |
| 7,538,673 | B2 * | 5/2009 | Balachandran et al. | 340/572.1 |
| 2003/0006936 | A1 * | 1/2003 | Aoyama et al. | 343/700 MS |
| 2003/0048225 | A1 * | 3/2003 | Yoon | 343/700 MS |
| 2004/0008141 | A1 * | 1/2004 | Sato et al. | 343/700 MS |
| 2006/0049990 | A1 * | 3/2006 | Watada et al. | 343/700 MS |

(Continued)

FOREIGN PATENT DOCUMENTS

| | | |
|---|---|---|
| JP | 09-270626 | 10/1997 |

(Continued)

OTHER PUBLICATIONS

KIPO Notice of Patent Grant dated Sep. 13, 2007 for the corresponding application KR 10-2006-0061387.

*Primary Examiner*—Julie Lieu
(74) *Attorney, Agent, or Firm*—Ladas & Parry LLP

(57) ABSTRACT

An antenna and a radio frequency identification (RFID) tag using the same are disclosed. The antenna includes: a radiating unit having a helical structure; and a feeding unit having a loop structure on which a terminal connected to an element connected to the antenna is formed, wherein the feeding unit is electromagnetically induced and coupled with the radiating unit to be apart from each other.

25 Claims, 11 Drawing Sheets

U.S. PATENT DOCUMENTS

| | | | | |
|---|---|---|---|---|
| 2006/0132360 | A1* | 6/2006 | Caimi et al. | 343/700 MS |
| 2006/0158380 | A1* | 7/2006 | Son et al. | 343/748 |
| 2007/0001925 | A1* | 1/2007 | Bae et al. | 343/895 |
| 2007/0281657 | A1* | 12/2007 | Brommer et al. | 455/334 |
| 2008/0111662 | A1* | 5/2008 | Sakama et al. | 340/10.1 |

FOREIGN PATENT DOCUMENTS

| | | |
|---|---|---|
| KR | 1999-0048972 | 7/1999 |
| KR | 1020030007569 | 1/2003 |

* cited by examiner

Feeding unit of bow-tie shape

Radiating unit of step shape

Radiating unit having slot or groove

ANTENNA HAVING LOOP AND HELICAL STRUCTURE AND RFID TAG USING THE SAME

FIELD OF THE INVENTION

The present invention relates to an antenna and a radio frequency identification (RFID) tag using the same; and more particularly, to an antenna having loop and helical structure, and a radio frequency identification (RFID) tag using the same.

DESCRIPTION OF RELATED ARTS

A radio frequency identification (RFID) tag is used in various fields, e.g., a resource management and security management with a radio frequency identification (RFID) reader.

In general, if an object having an RFID tag is put on a read zone of the RFID reader, the RFID reader modulates a radio frequency (RF) signal having a specific carrier frequency, and transmits an interrogation signal to the RFID tag. The RFID tag responds to the interrogation signal of the RFID reader. That is, the RFID reader modulates a continuous electromagnetic wave having a specific frequency and transmits an interrogation signal to the RFID tag. The RFID tag performs back-scattering modulation for an electromagnetic wave transmitted from the RFID reader and returns the back-scattering modulated signal to the RFID reader for transmitting information stored in a memory of the RFID tag.

When the RFID tag scatters the electromagnetic wave transmitted from the RFID reader and re-transmits the scattered electromagnetic wave to the RFID reader, the back-scattering modulation represents to transmit tag information by modulating a phase or amplitude of the scattered electromagnetic wave.

A passive RFID tag not having an RF transmitter rectifies an electromagnetic wave transmitted from the RFID reader for obtaining an operational power and uses the rectified electromagnetic wave as a power source. In order to operate the passive RFID tag under a normal state, an intensity of the electromagnetic wave transmitted from the RFID reader should be larger than a threshold value at a location of the RFID tag. That is, a read zone of the RFID reader is limited by the intensity of the electromagnetic wave transmitted from the RFID reader to the RFID tag. However, a transmitting power of the RFID reader is limited by a local regulation or a federal communication commission (FCC) of U.S. Accordingly, the RFID tag has to efficiently receive the electromagnetic wave transmitted from the RFID tag in order to widen the read zone without increasing the transmitting power.

A matching circuit is one of solutions for increasing an efficiency of the RFID tag. In general, a RFID tag includes an antenna, an RF front-end and a signal processing unit. The RF front-end and signal processing units are manufactured in one chip. A method using a matching circuit maximizes an intensity of a signal transmitted from the antenna to the RF front-end by conjugate-matching the antenna and the RF front-end through the matching circuit. However, the matching circuit which includes a combination of a capacitor and an inductor has miniaturization and cost problem since the matching circuit needs large area in a chip.

Moreover, the intensity of the electromagnetic wave transmitted from the RFID reader to the RFID tag may be reduced by a path loss and an influence of an object having the RFID tag. Particularly, if the object having the RFID tag is a liquid, an electromagnetic distortion occurs by a coupling between the antenna and the liquid, and the intensity of the electromagnetic wave which is induced to the antenna is reduced.

SUMMARY OF THE INVENTION

It is, therefore, an object of the present invention to provide an antenna and a radio frequency identification (RFID) tag using the same having the loop structure and the helical structure which may be efficiently matched to an antenna element having predetermined complex impedance; and more particularly, which are capable of being efficiently matched with the RF front-end having a larger capacitive reactance than a resistance element.

It is, therefore, an another object of the present invention to provide an RFID tag which is capable of recognizing an object and not having influenced on the gain of the tag antenna although a liquid substance having electromagnetic wave interference characteristics exists under the tag antenna.

In accordance with an aspect of the present invention, there is provided an antenna, including: a radiating unit having a helical structure; and a feeding unit having a loop structure on which a terminal connected to an element connected to the antenna is formed, wherein the feeding unit is electromagnetically induced and coupled with the radiating unit to be apart from each other.

In accordance with another aspect of the present invention, there is provided a radio frequency identification (RFID) tag, including: an antenna receiving a radio frequency (RF) signal transmitted from an RFID reader; an RF front-end rectifying and detecting the RF signal; and a signal processing unit being connected to the RF front-end, wherein the antenna includes a radiating unit having a helical structure and a feeding unit having a loop structure on which a terminal connected to the RF front-end is formed, and the feeding unit and the radiating unit are electromagnetically induced and coupled to be apart each other.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

The advantages, features and aspects of the invention will become apparent from the following description of the embodiments with reference to the accompanying drawings, which is set forth hereinafter. Hereinafter, preferred embodiments of the present invention will be described in detail with reference to the accompanying drawings.

Figure 1:
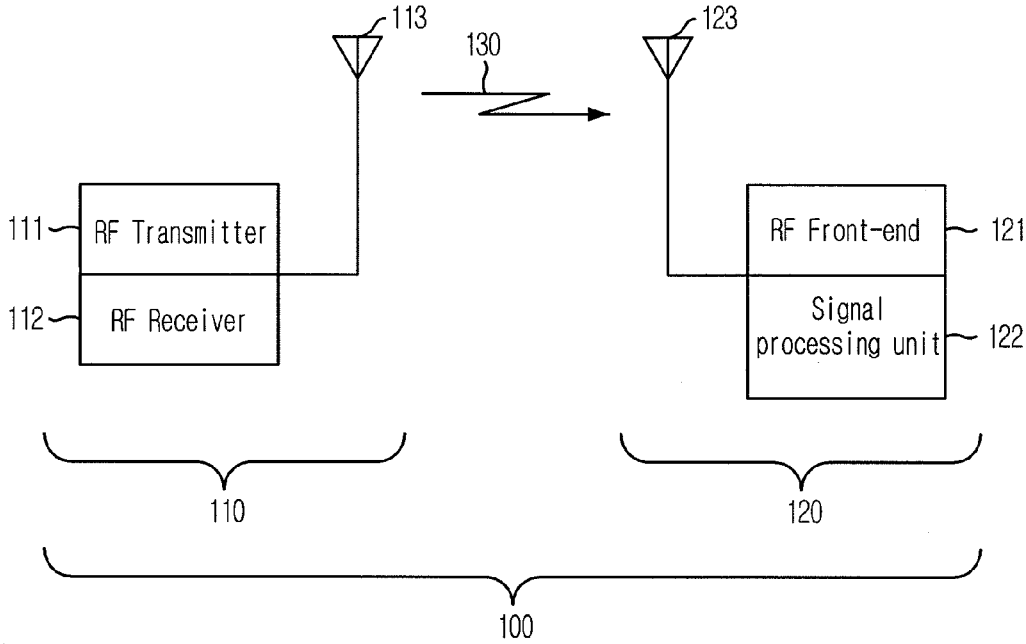
FIG. 1 is a block diagram showing an RFID system in accordance with an embodiment of the present invention.

FIG. 1 is a block diagram showing an RFID system 100 in accordance with an embodiment of the present invention. The RF system 100 includes an RFID tag 120 having identification information, an RFID reader 110 having a reading function, and a host computer (not illustrated in FIG. 1) processing data which is read from the RFID tag 120 through the RFID reader.

The RFID reader 110 includes an RF transmitter 111, an RF receiver 112, and a reader antenna 113. The read antenna 113 is electrically connected to the RF transmitter 111 and the RF receiver 112. The RFID reader 110 transmits an RF signal to the RFID tag 120 through the RF transmitter 111 and the reader antenna 113. The RFID reader 110 receives an RF signal from the RFID tag 120 through the reader antenna 113 and the RF receiver 112. As described in U.S. Pat. No. 4,656,463, since a configuration of the RFID reader 110 is known to those skilled in the art, a description for the configuration of the RFID reader 110 will be omitted.

The RFID tag 120 includes an RF front-end 121, a signal processing unit 122 and a tag antenna 123. If the RFID tag is a passive RFID tag, the RF front-end 121 converts a received RF signal to a DC voltage and provides power to the signal processing unit 122. The RF front-end 121 extracts a base band signal from the received RF signal. As described in U.S. Pat. No. 6,028,564., since a configuration of the RF front-end 121 is known to those skilled in the art, a description for the configuration of the RFID reader 110 will be omitted. Moreover, as described in U.S. Pat. No. 5,942,987., since a configuration of the signal processing unit 122 is known to those skilled in the art, a description for the configuration of the signal processing unit 122 will be omitted.

The RFID reader 110 modulates the RF signal having a specific carrier frequency and transmits an interrogation to the RFID tag 120. The RF signal generated in the RF transmitter 111 of the RFID reader 110 is transmitted to an external apparatus through the reader antenna 113. The electromagnetic wave 130 transmitted to the external apparatus is transmitted to the tag antenna 123. The tag antenna 123 having a loop structure and a helical structure transmits the received electromagnetic wave to the RF front-end 121.

If an amplitude of the RF signal transmitted to the RF front-end 121 is larger than a minimum power to operate the RFID tag 120, the RFID tag 120 performs a back-scattering modulation for the electromagnetic wave 130 transmitted from the RFID reader 110 and responds to the interrogation of the RFID reader 110.

In order to widen a read zone of the RFID reader 110, the amplitude of the electromagnetic wave 130 transmitted from the RFID reader 110 is so large as to provide an operational power to the RFID tag 120. Moreover, the electromagnetic wave 130 transmitted from the RFID reader 110 is transmitted to the RF front-end 121 through a high-efficient tag antenna 123 without a loss. Finally, in order to have the high-efficient tag antenna 123, the tag antenna 123 has resonant characteristics in a carrier frequency of the RFID reader 110, and becomes a complex conjugate matching with the RF front-end 121.

Figure 2:
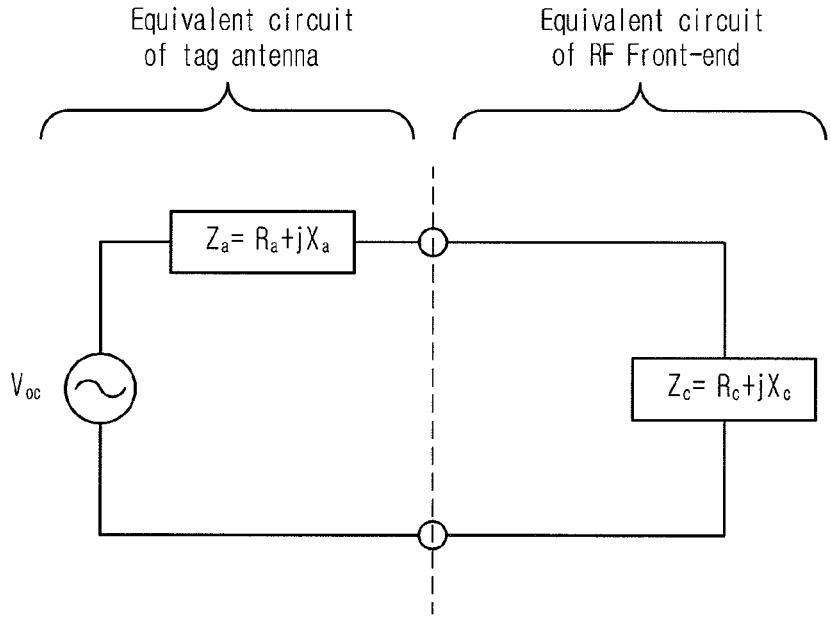
FIG. 2 is a circuit diagram showing an equivalent circuit which is modeling a tag antenna and an RF front-end in accordance with an embodiment of the present invention.

FIG. 2 is a circuit diagram showing an equivalent circuit which is modeling a tag antenna and an RF front-end in accordance with an embodiment of the present invention. The equivalent circuit includes of a voltage source ($V_{oc}$), antenna impedance ($Z_a$), and RF front-end impedance ($Z_c$).

The voltage source ($V_{oc}$) and antenna impedance ($Z_a$) is equivalent circuit to the tag antenna 123. The RF front-end impedance ($Z_c$) is an equivalent circuit to the RF front-end 121. The antenna impedance ($Z_a$) has a real part ($R_a$) and an imaginary part ($X_a$). The real part ($R_a$) means an equivalent resistance to the tag antenna 123, and the imaginary part ($X_a$) means an equivalent reactance of the tag antenna 123. The RF front-end impedance ($Z_c$) has a real part ($R_c$) and an imaginary part ($X_c$). The real part ($R_c$) means an equivalent resistance to the RF front-end 121, and the imaginary part ($X_c$) means an equivalent reactance of the RF front-end 121.

In general, if the antenna impedance ($Z_a$) becomes a complex conjugate matching with the RF front-end impedance ($Z_c$), a maximum power is transmitted from the tag antenna 123 to the RF front-end 121. The complex conjugate matching means that two complex impedances have the same absolute value and an opposite phase. That is, if the impedance of the tag antenna 123 or the impedance of the RF front-end 121 is adjusted to be $|R_a=R_c|$ and $|X_a=-X_c|$, the maximum power is transmitted from the tag antenna 123 to the RF front-end 121.

In general, the RF front-end 121 of a passive RFID tag includes rectifying and detecting circuits using a diode, and does not include a matching circuit for reducing an area of a chip. Accordingly, the impedance of the RF front-end 121 has complex impedance different from a normal 50Ω and has a small resistance element ($R_c$) and a large capacitive reactance element ($X_c$) in 900 MHz band due to characteristics of the rectifying circuit.

Accordingly, the antenna impedance ($Z_a$) for the complex conjugate matching has a small resistance element ($R_a$) and a large inductive reactance element ($X_a$), and is resonant with the frequency of the electromagnetic wave transmitted from the RFID reader 110. The tag antenna 123 according to an embodiment of the present invention is effectively matched to the RF front-end by adjusting the antenna impedance to have the large inductive reactance based on a loop structure.

Figure 3:
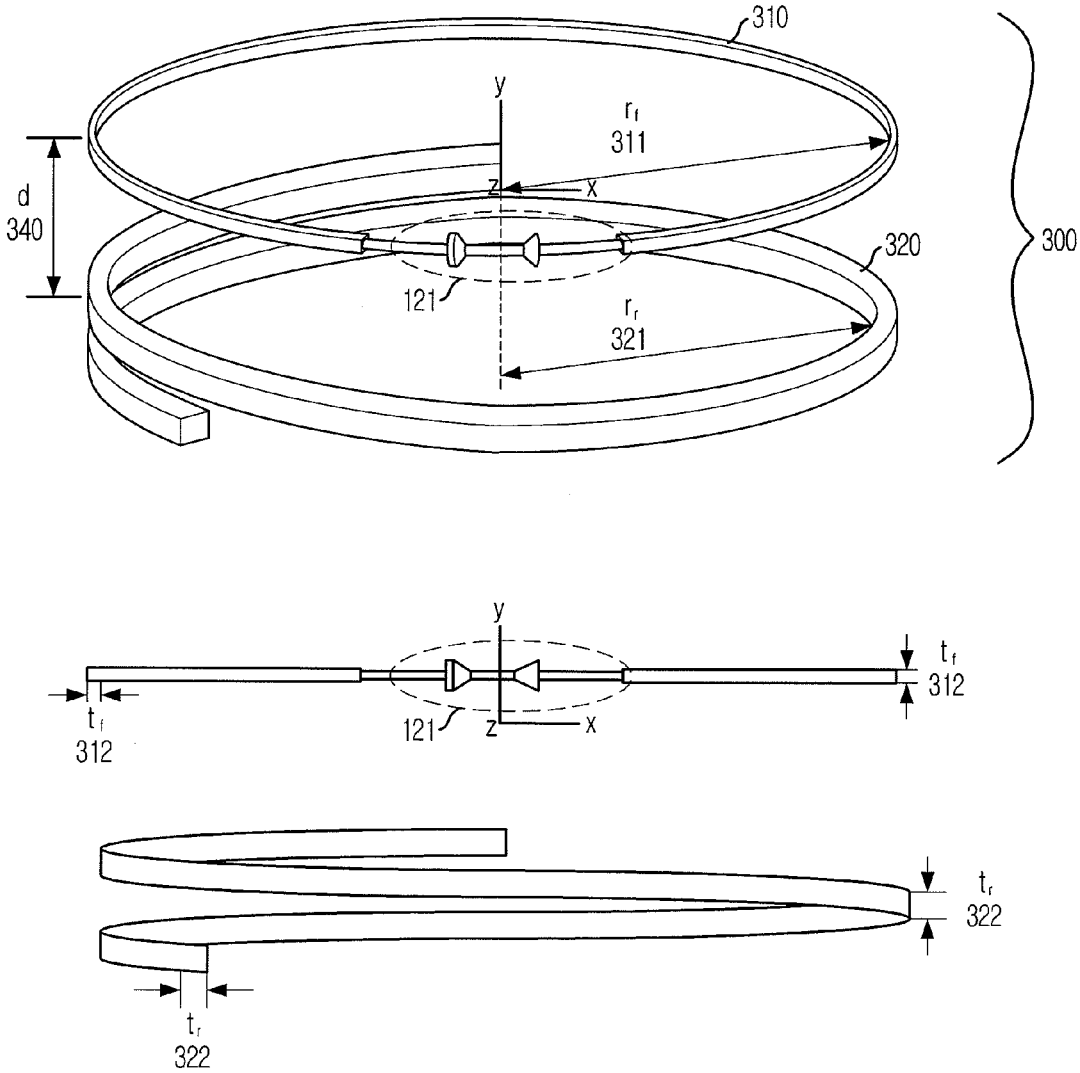
FIG. 3 is a block diagram showing a tag antenna using a loop structure and a helical structure in accordance with an embodiment of the present invention.

FIG. 3 is a block diagram showing a tag antenna using a loop structure and a helical structure in accordance with an embodiment of the present invention.

A tag antenna 300 includes a feeding unit 310 of a loop structure and a radiating unit 320 of a helical structure. The feeding unit 310 is a loop shape of which a part connected to a front-end is removed. Both ends of the feeding unit 310 are connected to the front-end 121. In an embodiment of the present invention, the tag antenna 300 is embodied on a bottle cap based on the fact that a tag read range is the same with a free space in a case that a distance between a tag and a liquid is above 3 cm.

If a thickness ($t_f$) 312 of a wire of the feeding unit 310 is reduced, the feeding unit 310 is easily attached to a tag chip, and has an efficient inductive coupling and a large input resistance. However, if the thickness ($t_f$) 312 of the wire is increased, an inductive reactance of the feeding unit 310 is increased by increasing an efficient area of the loop, and a resonant frequency of the feeding unit 310 is increased.

If a loop radius ($R_f$) 311 of the feeding unit 310 is reduced, an inductive reactance of the feeding unit 310 is decreased by reducing an efficient area of the loop, and a resonant frequency of the feeding unit 310 is decreased. It is preferable that the radius ($R_f$) 311 of the feeding unit 310 is larger than a size of the bottle cap by 0.8 mm to 1 mm.

The radiating unit 320 has a helical structure and is loaded to be apart from the feeding unit at a certain distance (d) 340. If the radiating unit 320 is loaded on the feeding unit 310 of a loop structure, a second harmonic resonant frequency is formed by a mutual coupling of the feeding unit 310 and the radiating unit 320 in addition to the resonant frequency of the feeding unit 310.

The tag antenna 300 according to an embodiment of the present invention is communicated with an RFID reader by using the second harmonic resonant frequency. That is, since each of the feeding unit 310 and the radiating unit 320 of the tag antenna 300 is a circle shape having a similar radius, the second harmonic resonant frequency is generated by a mutual inductive reactance.

Meanwhile, if the thickness ($t_r$) 322 of the radiating unit 320 is increased, an intensity of radiation is increased, and an input resistance is increased, and an inductive coupling of the feeding unit 310 and the radiating unit 320 is performed easily. A size of a radius ($r_r$) 321 of the radiating unit 320 is determined so that a wire is wound to a certain bottle cap which is not made of a metallic material. It is preferable that the radius of the radiating unit 320 is the same with the radius of the bottle cap. Moreover, the radiating unit 320 is made of a conductive wire, a thin copper film, or a conductive line.

Figure 4:
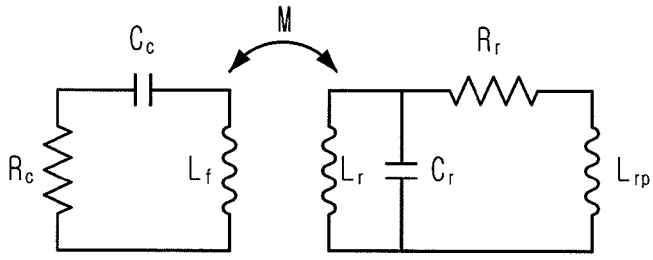
FIG. 4 is a circuit diagram showing an equivalent circuit which is modeling a tag antenna in accordance with an embodiment of the present invention.

FIG. 4 is a circuit diagram showing an equivalent circuit which is modeling a tag antenna in accordance with an embodiment of the present invention.

The equivalent circuit includes an equivalent impedance ($Z_c$) of the RF front-end 121, an equivalent impedance ($Z_f$) of the feeding unit 310, an equivalent impedance ($Z_r$) of the radiating unit 320, and a transformer having a mutual impedance (M).

The equivalent impedance ($Z_c$) of the RF front-end 121 includes a resistance element ($R_c$) and a capacitive reactance ($C_c$), and is represented by Eq. (1).

$$Z_c=R_c+1/jwC_c \quad \text{Eq. (1)}$$

The equivalent impedance ($Z_f$) of the feeding unit 310 is represented by Eq. (2) based on an inductance of a loop ($L_f$).

$$Z_f=jwL_f \quad \text{Eq. (2)}$$

The equivalent impedance ($Z_r$) of the radiating unit 320 includes a resistance element ($R_r$), a parasitic capacitive reactance ($C_r$) according to a gap (d) 340 between the feeding unit 310 and the radiating unit 320 and a self-mutual inductance ($L_{rp}$) according to the overlapped region in the helical structure of the radiating unit 320, and is represented by Eq. (3).

$$Z_r=jwL_r+(R_r+jwL_{rp})//(1/jwC_r) \quad \text{Eq. (3)}$$

The parasitic capacitive reactance ($C_r$) means a reactance element when the radiating unit 320 is regarded as a simple loop. The helical structure of the radiating unit 320 is represented by the self-mutual inductance ($L_{rp}$). The self-mutual inductance ($L_{rp}$) induces a current to the radiating unit 320 based on an electric field generated in the loop of the feeding unit 310. Moreover, the radiating unit 320 is one line on which a current flows to the same direction according to the principle that a current flows to the same direction on parallel lines having a predetermined gap. The current element is called as "pair of parallel current element".

The resistance element ($R_r$) of the radiating unit 320 is adjusted by a gap (d) between the feeding unit 310 and the radiating unit 320. Accordingly, the resistance element ($R_r$) of the radiating unit 320 is matched with the resistance element ($R_c$) of the RF front-end 121 by adjusting the gap between the feeding unit 310 and the radiating unit 320. The self-mutual inductance ($L_{rp}$) is adjusted based on a cross length of the radiating unit 320.

The RF front-end 121 is connected to the loop of the feeding unit 310 for the complex conjugate matching with the tag antenna 300. The equivalent circuit of the feeding unit 310 and the RF front-end 121 is converted into inductive circuit. An inductive reactance element induced by a connection of the feeding unit 310 with the RF front-end 121 is varied based on a mutual coupling coefficient (M), and determines a resonant frequency band along with the parasitic capacitive reactance ($C_r$) and self-mutual inductance ($L_{rp}$) In particular, if the number of winding in the helical structure of the radiating unit 320 is increased, the self-mutual inductance ($L_{rp}$) is increased but the parasitic capacitive reactance ($C_r$) decreases. The radiating frequency is transited by the increased self-mutual inductance ($L_{rp}$) and the decreased parasitic capacitive reactance ($C_r$). Accordingly, the tag antenna 300 shifts a radiating frequency to a requested band without a change of an input resistance by adjusting the number of the winding of the radiating unit 310.

The radiating unit 320 has a helical structure, and is manufactured by winding a wire so as to have an electric structure of a screw shape. The radiating unit 320 generates a frequency resonant by a pitch angle parameter having the diameter and the number of the winding, a gap between wound elements, and a line which is tangential element between a plane of a helical axis direction and a helical wire.

The input impedance depends on a valve of the pitch angle and a radius of the helical wire. A normal mode helical antenna has an electrically small size, a low gain, and narrow-band frequency characteristics. However, a radiating field is a maximum to a normal vector direction of a screw axis.

Figure 5:
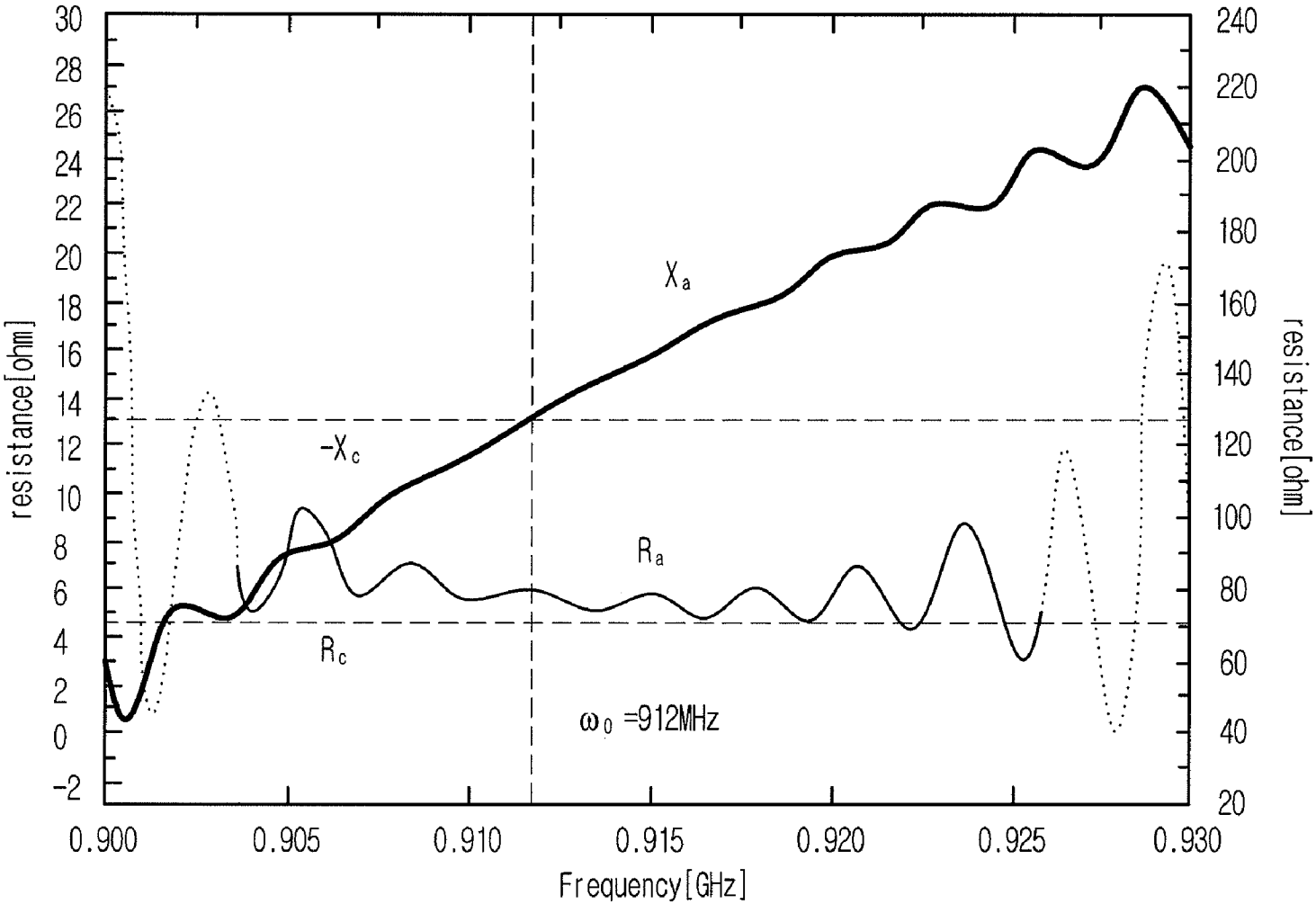
FIG. 5 shows a graph illustrating a change of an input impedance of a tag antenna according to a frequency change.

FIG. 5 shows a graph illustrating a change in an input impedance of a tag antenna according to a frequency change. The loop radius ($r_f$) 311 of the feeding unit 310 is 14.8 mm, and the thickness ($t_f$) 312 of the helical wire is 0.38 mm respectively. The loop radius ($r_r$) 321 of the radiating unit 320 is 0.95 mm, and the thickness ($t_f$) 322 of the helical wire is 14.0 mm respectively. The gap (d) between the feeding unit 310 and the radiating unit 320 is 4 mm.

The resistance element ($R_a$) and the reactance element ($X_a$) of the input impedance of the tag antenna 300 are conjugate-matched with the impedance ($Z_c=R_c+jX_c$) of the RF front-end 121 at a resonant frequency ($w_o$=912 MHz). The resistance element ($R_a$) of the input impedance of the tag antenna 300 has a constant value near the resonant frequency. The reactance element ($X_a$) of the input impedance of the tag antenna 300 is proportion to the frequency.

Figure 6:
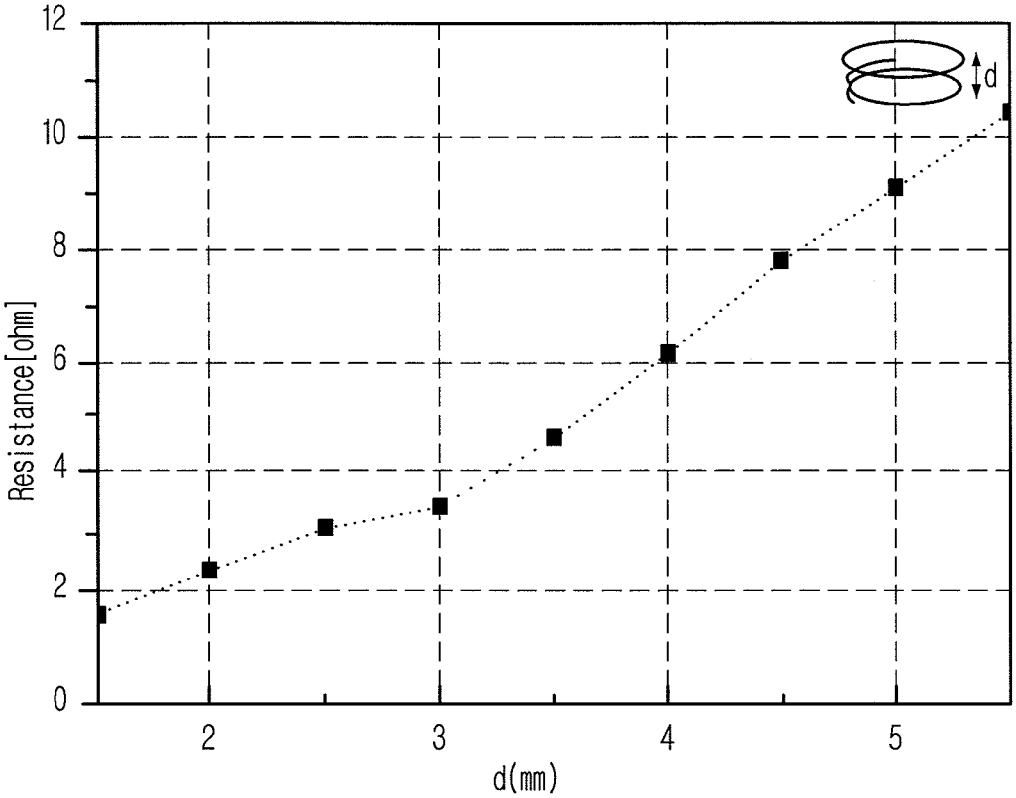
FIG. 6 shows a graph illustrating a resistance change of input impedance of a tag antenna according to a gap between a feeding unit and a radiating unit.

FIG. 6 shows a graph illustrating a resistance change of input impedance of a tag antenna according to a gap between a feeding unit and a radiating unit.

The other values except the gap (d) between the feeding unit 310 and the radiating unit 320 are the same with the values shown in FIG. 5. Since the resistance element ($X_a$) is proportion to the gap (d) between the feeding unit 310 and the radiating unit 320, the resistance element ($X_a$) is matched with the resistance element ($R_c$) of the front-end impedance by adjusting the gap (d).

Figure 7:
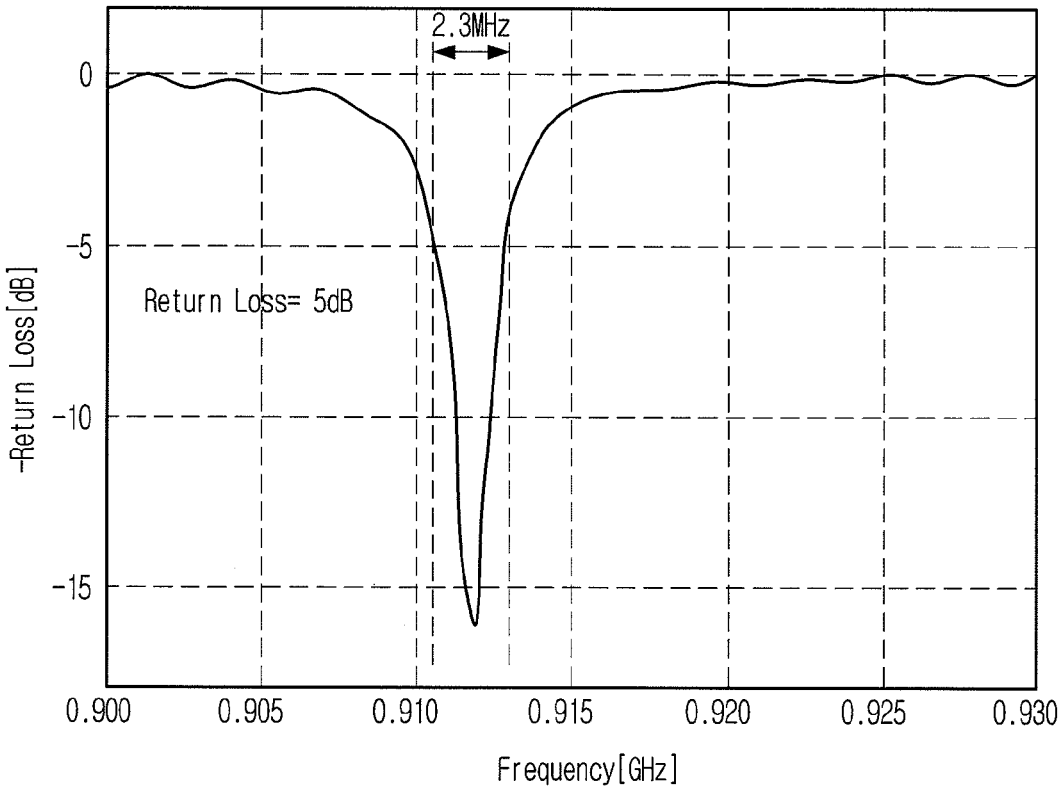
FIG. 7 shows a graph illustrating a reflective loss for a tag antenna in accordance with an embodiment of the present invention.

FIG. 7 shows a graph illustrating a reflective loss for a tag antenna in 900 MHz-930 MHz band in accordance with an embodiment of the present invention. The loop radius 311 of the feeding unit 310, the thickness ($t_f$) 312 of the wire, the loop radius 321 of the radiating unit 320 and the thickness 322 of the wire are the same with the values shown in FIG. 5.

If a frequency bandwidth is defined to be centered on −5 dB based on the tag antenna having narrowband small antenna characteristics, the tag antenna 300 shown in the FIG. 3 has a narrow bandwidth from 2.3 MHz to 4 MHz at a reference frequency of 910 MHz. Since the passive RFID system communicates through ten channels having a frequency bandwidth of 200 KHz, the tag antenna 300 needs the minimum bandwidth of 2 MHz.

Meanwhile, the shape of the feeding unit 310 or radiating unit 320 may be changed to extend a bandwidth of the tag antenna 300.

Figure 8A:
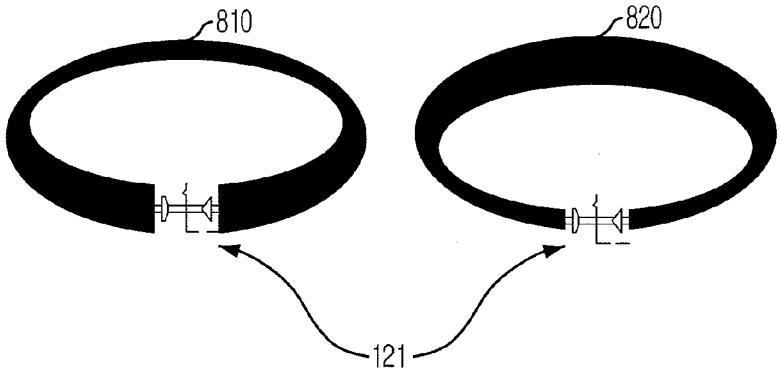
FIGS. 8A to 8C show the shapes of a feeding unit and a radiating unit of a tag antenna in accordance with an embodiment of the present invention.
Figure 8B:
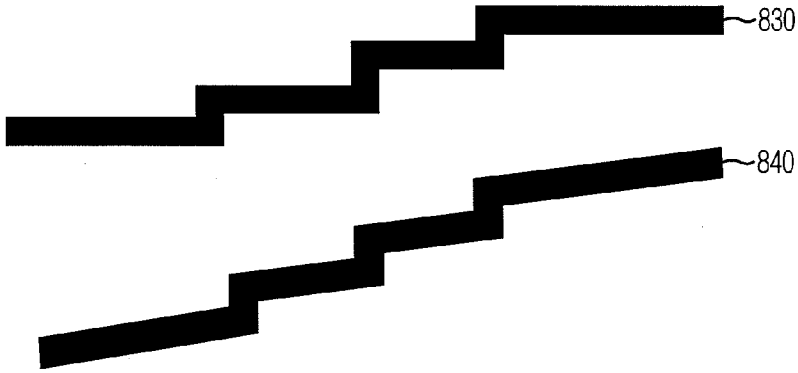
Figure 8C:
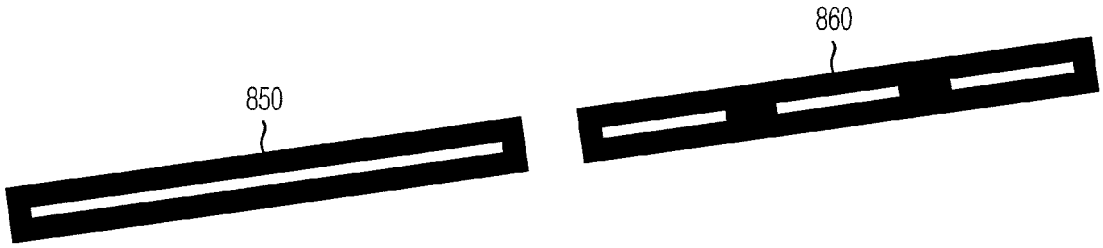

FIGS. 8A to 8C show the shapes of a feeding unit and a radiating unit of an antenna in accordance with an embodiment of the present invention. The bandwidth of the feeding units 810 and 820 may be increased by manufacturing the feeding units 810 and 820 to be a bow-tie shape as shown in FIG. 8A.

The bandwidth of the radiating units 830 and 840 may be increased by manufacturing the radiating units 830 and 840 to be step shape or a slanted step shape when the radiating units 830 and 840 are unfolded as shown in FIG. 8B.

Moreover, the bandwidth of the radiating units 850 and 860 may be increased by manufacturing the radiating units 850 and 860 to be radiating lines having a groove or a slot as shown in FIG. 8C.

Figure 9:
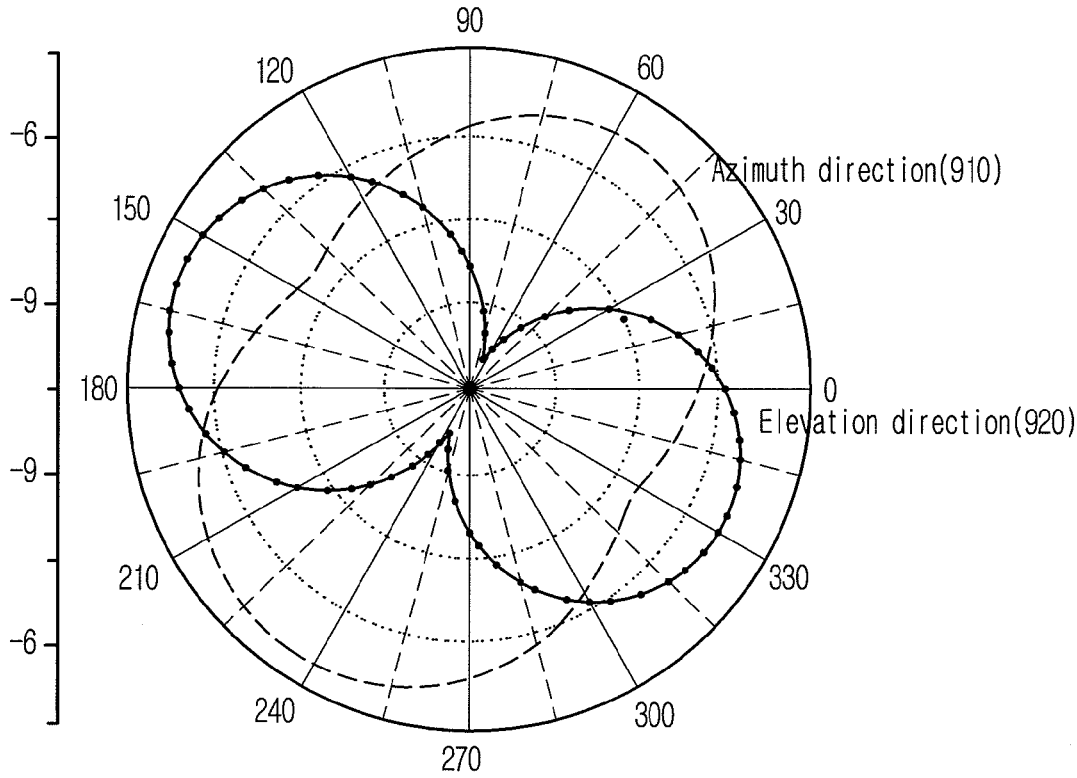
FIG. 9 shows a radiation pattern of a tag antenna according to an elevation direction and an azimuth direction.

FIG. 9 shows a radiation pattern of an antenna according to an elevation direction and an azimuth direction. A gain value of the tag antenna 300 is represented according to an azimuth angle 910 and an elevation angle 920 based on polarization characteristics of the reader antenna.

When the reader antenna is in the state of a left hand circular polarization, the tag antenna 300 has a gain of −5 dB, and there is no null in a specific azimuth angle. Moreover, if the tag antenna 300 is located at 0°, a first maximum radiation occurs at 240°, and a second maximum radiation occurs at 60°.

Since a long distance radiation of an electric field in the tag antenna 300 occurs at a cross portion of the radiating unit of the tag antenna 300, a read range of the azimuth direction may be omni-directional if the cross portion of the radiating unit of the tag antenna 300 is extended.

A maximum gain of the elevation direction 920 occurs at the inclination of 30° from the tag antenna 300. Since a minimum gain of the elevation direction 920 occurs at the inclination of near −90°, although a liquid substance having electromagnetic wave interference characteristics exists under the tag antenna 300, the liquid substance has not influenced on the gain of the tag antenna.

Figure 10:
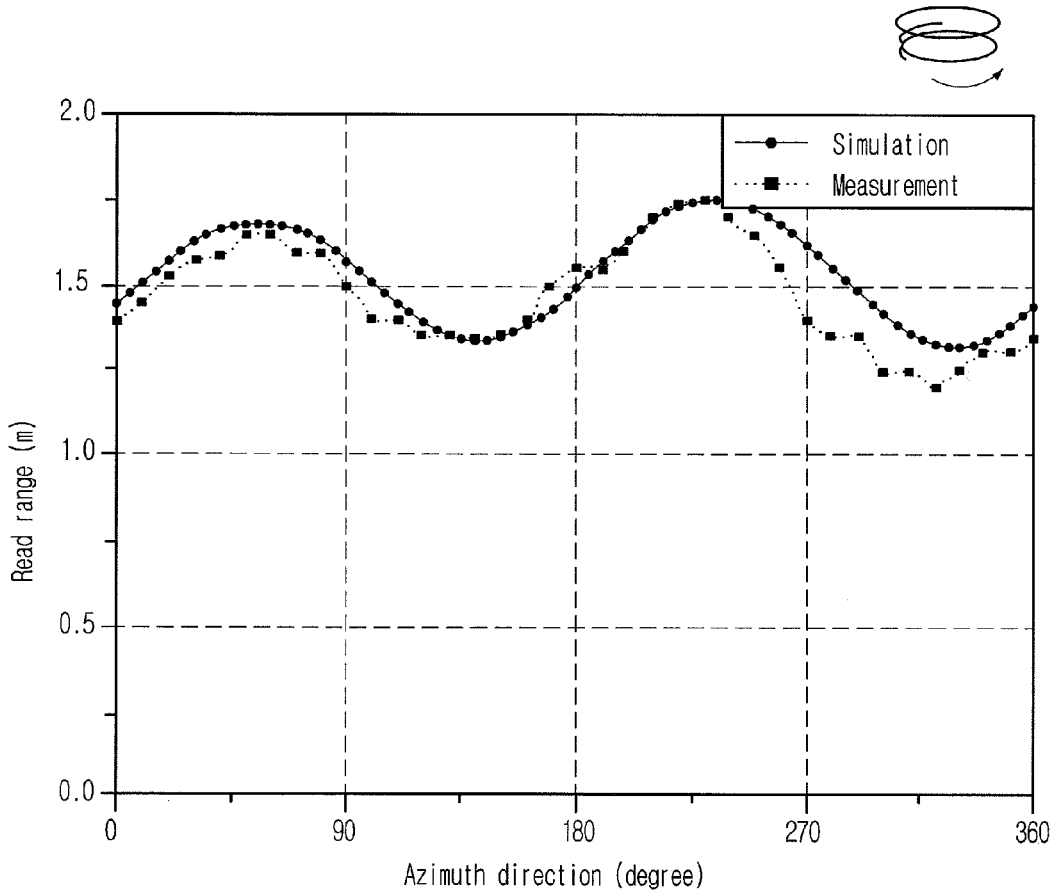
FIG. 10 shows a graph illustrating a read range of a tag antenna according to an azimuth direction.
Figure 11:
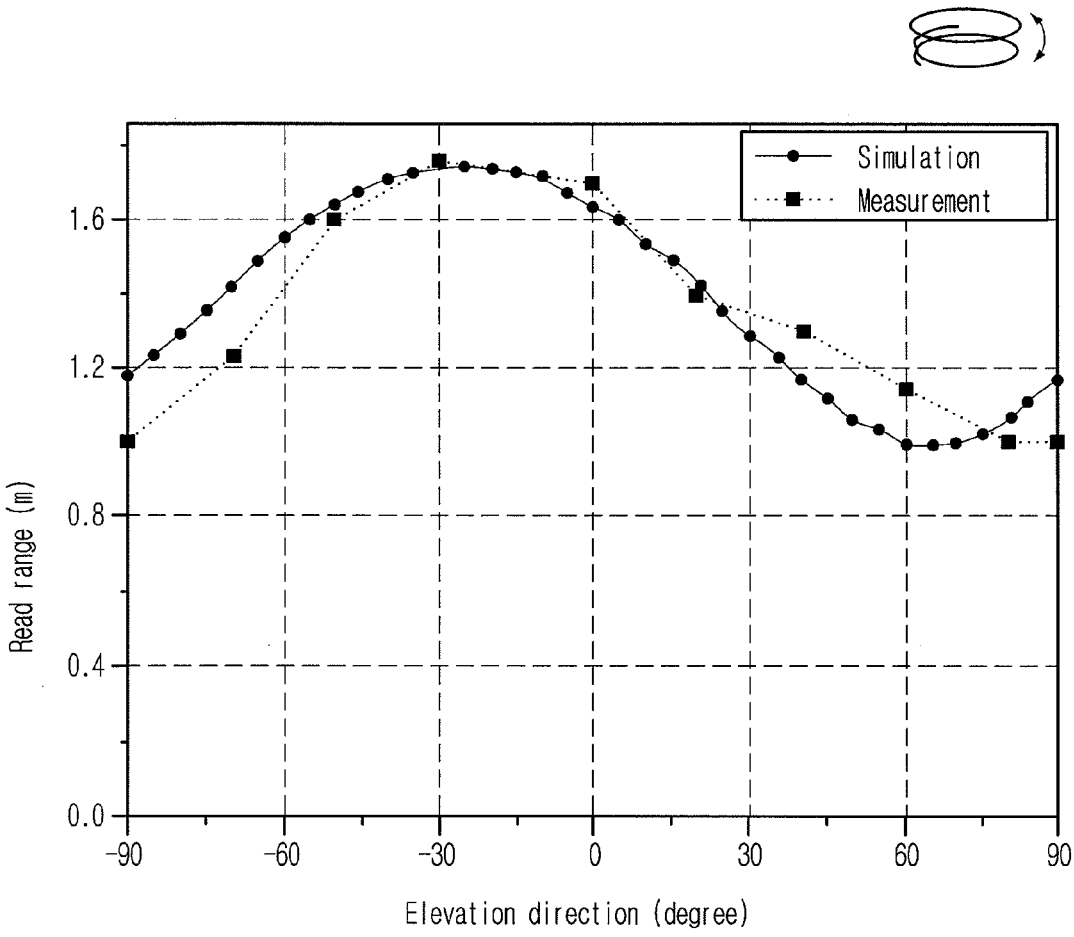
FIG. 11 shows a graph illustrating a read range of a tag antenna according to an elevation direction.

FIG. 10 shows a graph illustrating a measured read range and a simulated result of an antenna when the tag antenna rotates to an azimuth direction. FIG. 11 shows a graph illustrating a measured read range and a simulated result of an antenna when the tag antenna rotates to an elevation direction.

The length of each element 311, 312, 321, 322 and 320 of the tag antenna 300 used in measurement is the same with the length of the tag antenna shown in FIG. 5. The RFID reader 110 using a circular polarization has a power of 1[W] and an antenna gain of 5.9[dB]. The read range in the simulation is normalized to a maximum value of the measured read range based on various measuring elements.

Referring to FIG. 10, the read range of the tag antenna 300 having omni-directional characteristics has a maximum value of 1.7 [m] and a minimum value of 1.3 [m]. A maximum radiation occurs at a cross portion of the helical structure.

Referring to FIG. 11, the radiation axis is slanted to 30° from the elevation direction. The tag antenna 100 has a read range of 1 [m] at the position which is slanted to 90° from the elevation direction.

In general, the read range in a passive RFID system is under influence of a forward link which represents electromagnetic wave propagation from a reader antenna to a tag antenna through an air medium. The read range is calculated by substituting a gain value of the azimuth direction or an elevation direction by Friis transmission formula as Eq. (4).

$$20\log R_{km} = P_{reader(dBm)} + G_{reader(dB)} - P_{tag(dBm)} + G_{tag(dB)} - 20\log f_{MHz} - 32.44 - PLF \quad \text{Eq. (4)}$$

The $R_{km}$ denotes a distance between the RFID tag antenna and the reader antenna. The $P_{reader(dBm)}$ denotes an output power of the RFID reader. The $G_{reader(dBm)}$ denotes a gain of the reader antenna. The $P_{tag(dBm)}$ denotes a minimum threshold power of the RF front-end. The $G_{tag(dBm)}$ denotes a gain of the tag antenna. The $f_{MHz}$ denotes a carrier frequency of the RFID reader. The PLF denotes a loss according to a polarization between the reader antenna and the tag antenna. The read range means a physical distance between the reader antenna and the RFID tag.

Figure 12:
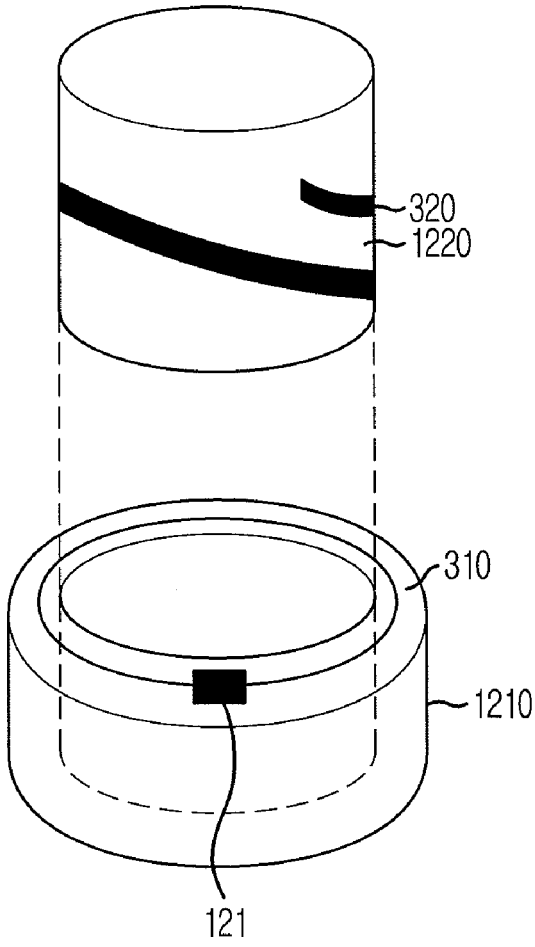
FIG. 12 illustrates a tag antenna in accordance with an embodiment of the present invention.

FIG. 12 illustrates an antenna in accordance with an embodiment of the present invention. In the embodiment of the present invention, the tag antenna 300 is applied to a cork attached to a plastic bottle of polyethylene terephthalate (PET) material.

Since the cost of the RF front-end 121 is higher than the cost of the tag antenna 300, it is preferable that the radiating unit 320 and the feeding unit 310 connected to the RF front-end 121 are manufactured respectively. The radius of the feeding unit 310 is larger than the radius of the radiating unit 320.

Since the loop without ground is not related to a dielectric constant, a supporting unit 1210 uses a plastic material. The supporting unit 1210 is easily attached and detached by being inserted into the cork 1220. An iron wire of circle shape which is attached to the cork 1220 is inserted into the supporting unit 1210. Although the read range of the tag antenna 300 is reduced, the radiating unit 320 is manufactured easily by attaching a metallic tape or printing a conductive ink.

If the metallic tape or conductive ink is used instead of the iron wire, a thickness of the radiating unit 320 becomes thin, and an input resistance of the tag antenna 300 increases. Thus, the height of the tag antenna 300 is reduced, and the length of the cross portion of the tag antenna 300 for the self-mutual inductance ($L_{rp}$) is lengthened. Accordingly, the read range of the tag antenna 300 may be dispersed in omni-direction.

The antenna having the loop structure and the helical structure according to an embodiment of the present invention may be efficiently matched to an antenna element having predetermined complex impedance.

In particular, the antenna and the RFID tag using the same according to the present invention are capable of being efficiently matched with the RF front-end having a larger capacitive reactance than a resistance element.

Moreover, the antenna and the RFID using the same according to the present invention have a maximum read range in an azimuth direction and omni-directional characteristics using the loop and helical structure. Although an electromagnetic wave interference object exists under the object having the RFID tag, the RFID tag recognizes the object without an influence on the gain of the antenna.

The antenna of the present invention transits a radiation frequency to a requested band through the number of the winding in the helical structure without the change of the input resistance, and may increase a maximum radiation angle from the antenna by increasing a cross portion in the helical structure.

The present application contains subject matter related to Korean patent application No. 2006-61387, filed in the Korean Intellectual Property Office on Jun. 30, 2006, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. An antenna, comprising:

a radiating unit having a helical structure; and a feeding unit having a loop structure on which a terminal connected to the antenna is formed, wherein the feeding unit and the radiating unit are separated by a gap and the feeding unit electromagnetically induces a current to the radiating unit, and wherein a resistance of the feeding unit is adjusted according to the gap.

2. The antenna as recited in claim 1, wherein a length of the radius of the feeding unit is longer than a length of the radius of the radiating unit.

3. The antenna as recited in claim 1, wherein the feeding unit is a bow-tie shape.

4. The antenna as recited in claim 1, wherein the radiating unit is a step shape.

5. The antenna as recited in claim 1, wherein the radiating unit includes a radiation line having a slot.

6. The antenna as recited in claim 1, wherein the radiating unit is attached to a cock of a liquid vessel.

7. The antenna as recited in claim 6, wherein the feeding unit is formed on a supporting unit into which the cock having the radiating unit is inserted.

8. The antenna as recited in claim 1, wherein an input resistance of the feeding unit is increased as a thickness of a wire of the feeding unit is decreased.

9. The antenna as recited in claim 1, wherein an input resistance of the feeding unit is increased as the gap separating the radiating unit and the feeding unit is increased.

10. The antenna as recited in claim 1, wherein a capacitive reactance of the feeding unit is increased as a radius of a loop of the feeding unit is increased.

11. The antenna as recited in claim 1, wherein a radiation frequency of the antenna is transitioned based on the number of the winding in a helical structure of the radiating unit.

12. The antenna as recited in claim 1, wherein a radiation pattern of the antenna has omni-directional characteristics as a length of a cross portion in a helical structure of the radiating unit increases.

13. A radio frequency identification (RFID) tag, comprising:

an antenna receiving a radio frequency (RF) signal transmitted from an RFID reader;

an RF front-end rectifying and detecting the RF signal; and a signal processing unit being connected to the RF front-end, wherein the antenna includes a radiating unit having a helical structure and a feeding unit having a loop structure on which a terminal connected to the RF front-end is formed, and the feeding unit and the radiating unit are separated by a gap and the feeding unit electromagnetically induces a current to the radiating unit, and wherein a resistance of the feeding unit is adjusted according to the gap.

14. The RFID tag as recited in claim 13, wherein a length of the radius of the feeding unit is longer than a length of the radius of the radiating unit.

15. The RFID tag as recited in claim 13, wherein the radiating unit is attached to a cock of a liquid vessel.

16. The RFID tag as recited in claim 15, wherein the radiating unit is made of a conductive tape or a conductive ink.

17. The RFID tag as recited in claim 15, wherein the feeding unit is formed on a supporting unit into which the cock having the radiating unit is inserted.

18. The RFID tag as recited in claim 13, wherein the feeding unit is a bow-tie shape.

19. The RFID tag as recited in claim 13, wherein the radiating unit is a step shape.

20. The RFID tag as recited in claim 13, wherein the radiating unit includes a radiation line having a slot.

21. The RFID tag as recited in claim 13, wherein an input resistance of the feeding unit is increased as a thickness of a wire of the feeding unit is decreased.

22. The RFID tag as recited in claim 13, wherein an input resistance of the feeding unit is increased as the gap separating the radiating unit and the feeding unit is increased.

23. The RFID tag as recited in claim 13, wherein a capacitive reactance of the feeding unit is increased as a radius of a loop of the feeding unit is increased.

24. The RFID tag as recited in claim 13, wherein a radiation frequency of the antenna is transitioned based on the number of the winding in a helical structure of the radiating unit.

25. The RFID tag as recited in claim 13, wherein a radiation pattern of the antenna has omni-directional characteristics as a length of a cross portion in a helical structure of the radiating unit increases.

* * * * *